US011176857B2

(12) United States Patent
Zhao

(10) Patent No.: US 11,176,857 B2
(45) Date of Patent: Nov. 16, 2021

(54) DISPLAY PANEL TESTING APPARATUS AND TESTING METHOD

(71) Applicants: CHONGQING ADVANCE DISPLAY TECHNOLOGY RESEARCH, Chongqing (CN); CHONGQING HKC OPTOELECTRONICS TECHNOLOGY CO., LTD., Chongqing (CN)

(72) Inventor: Wenqin Zhao, Chongqing (CN)

(73) Assignees: CHONGQING ADVANCE DISPLAY TECHNOLOGY RESEARCH, Chongqing (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 403 days.

(21) Appl. No.: 16/463,378

(22) PCT Filed: Nov. 16, 2018

(86) PCT No.: PCT/CN2018/115822
§ 371 (c)(1),
(2) Date: May 23, 2019

(87) PCT Pub. No.: WO2020/087579
PCT Pub. Date: May 7, 2020

(65) Prior Publication Data

US 2021/0327317 A1 Oct. 21, 2021

(30) Foreign Application Priority Data

Oct. 30, 2018 (CN) ..... 201811275213.X

(51) Int. Cl.
*G09G 3/00* (2006.01)

(52) U.S. Cl.
CPC ..... *G09G 3/006* (2013.01)

(58) Field of Classification Search
CPC ..... G09G 3/006
See application file for complete search history.

(56) References Cited

U.S. PATENT DOCUMENTS

2007/0165017 A1* 7/2007 Kubota et al. ..... G09G 3/2965 345/211

FOREIGN PATENT DOCUMENTS

| | | | |
|---|---|---|---|
| CN | 1591371 | A | 3/2005 |
| CN | 101686896 | A | 3/2010 |
| CN | 102054412 | A | 5/2011 |
| CN | 102063877 | A | 5/2011 |
| CN | 102332237 | A | 1/2012 |

(Continued)

OTHER PUBLICATIONS

International Search Report issued in corresponding International application No. PCT/CN2018/115822, dated Jul. 31, 2019(8 pages).

(Continued)

*Primary Examiner* — Noam Reisner

(57) ABSTRACT

This application discloses a display panel testing apparatus and testing method. When a data control circuit receives a first enable signal generated by a switching signal generation circuit, the data control circuit controls a data interface that is output by the data control circuit to be in a high-impedance state.

17 Claims, 2 Drawing Sheets

(56) References Cited

FOREIGN PATENT DOCUMENTS

| | | | | |
|---|---|---|---|---|
| CN | 202421485 | U | | 9/2012 |
| CN | 103941436 | A | | 7/2014 |
| CN | 204405990 | U | * | 6/2015 |
| CN | 204405990 | U | | 6/2015 |
| CN | 204463777 | U | | 7/2015 |
| CN | 106057106 | A | | 10/2016 |
| CN | 107452306 | A | | 12/2017 |
| CN | 107588925 | A | | 1/2018 |
| CN | 207397870 | U | | 5/2018 |
| CN | 108134930 | A | | 6/2018 |
| CN | 207780135 | U | | 8/2018 |
| KR | 20120012771 | A | | 2/2012 |

OTHER PUBLICATIONS

First Office Action from China patent office in a counterpart Chinese patent Application 201811275213.X, dated Jan. 15, 2020 (6 pages).
Second Office Action from China patent office in a counterpart Chinese patent Application 201811275213.X, dated Jul. 27, 2020 (10 pages).
Written Opinion of the International Searching Authority for No. PCT/CN2018/115822.

* cited by examiner

DISPLAY PANEL TESTING APPARATUS AND TESTING METHOD

This application claims priority to Chinese Patent Application No. CN201811275213.X, filed with the Chinese Patent Office on Oct. 30, 2018 and entitled "DISPLAY PANEL TESTING APPARATUS AND TESTING METHOD", which is incorporated herein by reference in its entirety.

TECHNICAL FIELD

This application relates to the field of display technologies, and in particular, to a display panel testing apparatus and testing method.

BACKGROUND

The description herein provides only background information related to this application, but does not necessarily constitute the existing technology.

Liquid crystal displays have many advantages such as a thin body, power saving, and no radiation, and are widely applied. Most of liquid crystal displays on the market are backlight-type liquid crystal displays, including liquid crystal panels and backlight modules. A working principle of a liquid crystal panel is placing liquid crystal molecules between two parallel glass substrates and applying a drive voltage to the two glass substrates to control rotation directions of the liquid crystal molecules, to refract light of the backlight module to generate a picture.

A main component of the liquid crystal display is a display panel. Production and manufacture of the display panel are very complex. Vendors test the display panel by using a testing apparatus in a display panel production process, to ensure quality of the display panel. However, the testing apparatus has low production efficiency and high production costs.

SUMMARY

An objective of this application is to provide a display panel testing apparatus and testing method, to improve production efficiency and reduce high production costs.

To achieve to foregoing objective, this application provides a display panel testing apparatus, comprising:

a testing circuit, configured to test a to-be-tested panel;

a data control circuit, provided with a data interface configured to control data transmission of the to-be-tested panel; and a power supply circuit, wherein the power supply circuit comprises a panel power-supply interface and a data control circuit power-supply interface, the panel power-supply interface is configured to supply power to the to-be-tested panel, and the data control circuit power-supply interface is configured to supply power to the data control circuit; and the testing apparatus further comprising:

a switching signal generation circuit, configured to generate a first enable signal when the to-be-tested panel needs to be replaced, and generate a second enable signal when a panel is normally tested after the replacement, wherein the switching signal generation circuit is configured to connect to and control the power supply circuit and the data control circuit;

when the power supply circuit receives the first enable signal, the power supply circuit controls an output of the panel power-supply interface of the power supply circuit to be zero V, and controls an output of the data control circuit power-supply interface of the power supply circuit to remain unchanged, to normally supply power to the data control circuit;

when the data control circuit receives the first enable signal, the data control circuit controls the data interface that is output by the data control circuit to be in a high-impedance state;

when the power supply circuit receives the second enable signal, the power supply circuit controls the output of the panel power-supply interface of the power supply circuit to be a normal voltage, and controls the data control circuit power-supply interface of the power supply circuit to output the normal voltage, to normally supply power to the data control circuit; and when the data control circuit receives the second enable signal, the data control circuit controls the data interface that is output by the data control circuit to be in a normal state.

This application further discloses a display panel testing method, wherein the display panel comprises: a data control circuit, provided with a data interface configured to control data transmission of a to-be-tested panel; and a power supply circuit, wherein the power supply circuit comprises a panel power-supply interface and a data control circuit power-supply interface, the panel power-supply interface is configured to supply power to the to-be-tested panel, and the data control circuit power-supply interface is configured to supply power to the data control circuit; and the testing method comprises:

a step of generating a switching signal; and a step of detecting the switching signal, wherein when it is detected that the switching signal is a second enable signal, controlling, by the power supply circuit, an output of a panel power-supply interface of the power supply circuit to be a normal voltage, and controlling a data control circuit power-supply interface of the power supply circuit to output a normal voltage, to normally supply power to the data control circuit; and controlling, by the data control circuit, a data interface that is output by the data control circuit to be in a normal state, to normally test a to-be-tested display panel; or when it is detected that the switching signal is a first enable signal, controlling, by the power supply circuit, an output of a panel power-supply interface of the power supply circuit to be zero V, and controlling an output of a data control circuit power-supply interface of the power supply circuit to remain unchanged, to normally supply power to the data control circuit; and controlling, by the data control circuit, a data interface that is output by the data control circuit to be in a high-impedance state, to replace a to-be-tested display panel.

This application further discloses a display panel testing apparatus, comprising:

a testing circuit, configured to test a to-be-tested display panel;

a power supply circuit, comprising: a power bleeder circuit, configured to generate a voltage supplying power to a data control circuit and a panel power-supply voltage supplying power to the panel; a panel power-supply interface, configured to supply power to the to-be-tested panel; and a panel power-supply switch, wherein the panel power-supply switch is arranged between the power bleeder circuit and the panel power-supply interface and configured to receive the panel power-supply voltage generated by the power bleeder circuit; and a data control circuit, comprising: a data interface, configured to control data transmission of the to-be-tested panel;

a data receiver circuit; an image data processing circuit, connected to the data receiver circuit; and a high-impedance switch, configured to connect to and control the data interface, wherein the image data processing circuit is in data connection with the to-be-tested panel by using the data interface;

the data receiver circuit is a system on chip (SOC), a preset pin of the SOC receives a signal generated by a switching signal generation circuit, and the high-impedance switch directly calls a high-impedance component built in the SOC to control the data interface that is output by the data control circuit to be in a high-impedance state;

the power supply circuit is provided with the panel power-supply interface and a data control circuit power-supply interface, the panel power-supply interface is configured to supply power to the to-be-tested panel, and the data control circuit power-supply interface is configured to supply power to the data control circuit;

the power bleeder circuit is integrated in the SOC, the panel power-supply interface comprises four interfaces: an analog power voltage VAAA interface, a thin film transistor switch-on voltage VGH interface, a thin film transistor switch-off voltage VGL interface, and a digital power voltage VDD interface; the panel power-supply switch is arranged outside the SOC; and there are four panel power-supply switches respectively in one-to-one control connection with the VAAA, VGH, VGL, and VDD interfaces of the SOC; and the panel power-supply switch comprises:

a first switch tube, a second switch tube, a first resistor, and a second resistor, where a gate of the first switch tube is configured to connect to and control an enable signal;

a drain of the first switch tube is connected, by using the first resistor and the second resistor that are connected in series, to the panel power-supply voltage generated by the power bleeder circuit of the power supply circuit; and a source of the first switch tube is grounded; and a gate of the second switch tube is connected between the first resistor and the second resistor; a source of the second switch tube is connected to the panel power-supply voltage generated by the power bleeder circuit of the power supply circuit; and the panel power-supply interface is connected to a drain of the second switch tube, wherein the testing apparatus further comprises:

the switching signal generation circuit, configured to generate a first enable signal when the to-be-tested panel needs to be replaced, and generate a second enable signal when a panel is normally tested after the replacement;

the switching signal generation circuit is configured to connect to and control the power supply circuit and the data control circuit;

the panel power-supply switch receives the signal generated by the switching signal generation circuit; and when the power supply circuit receives the first enable signal, the power supply circuit controls an output of the panel power-supply interface of the power supply circuit to be zero V, and controls an output of the data control circuit power-supply interface of the power supply circuit to remain unchanged, to normally supply power to the data control circuit;

when the high-impedance switch receives the first enable signal, the data control circuit controls the data interface that is output by the data control circuit to be in the high-impedance state;

when the power supply circuit receives the second enable signal, the power supply circuit controls the output of the panel power-supply interface of the power supply circuit to be a normal voltage, and controls the data control circuit power-supply interface of the power supply circuit to output the normal voltage, to normally supply power to the data control circuit; and when the high-impedance switch receives the second enable signal, the data control circuit controls the data interface that is output by the data control circuit to be in a normal state.

When a testing apparatus tests a display panel, if a whole testing system needs to be powered off in a display panel replacing process to prevent the display panel from being burned due to a short circuit, the whole testing apparatus needs to be restarted after a new to-be-tested display panel is replaced with, to continue to test the new to-be-tested display panel, and a time required by restart of a data control circuit is relatively long, causing low production efficiency, and increasing production costs. Compared with the foregoing solution, the testing apparatus in this solution includes the switching signal generation circuit. When the data control circuit receives the first enable signal generated by the switching signal generation circuit, the data control circuit controls the data interface that is output by the data control circuit to be in the high-impedance state. In this case, an operation of replacing with a new to-be-tested display panel can be performed, and the display panel is prevented from being burned due to a short circuit. In addition, the power supply circuit also receives the first enable signal generated by the switching signal generation circuit, and the power supply circuit controls the output of the panel power-supply interface of the power supply circuit to be zero V, and controls the output of the data control circuit power-supply interface of the power supply circuit to remain unchanged, to normally supply power to the data control circuit, so that the data control circuit does not need to be opened through power off. The display panel is not burned due to a short circuit while normal replacement of the display panel is ensured, and a time of turning off a system through power off and restarting the system is eliminated, thereby improving the production efficiency and decreasing the production costs.

BRIEF DESCRIPTION OF DRAWINGS

The accompanying drawings included are used for helping understand the embodiments of this application, constitute a part of this specification, illustrate examples of the embodiments of this application and, together with the description, serve to explain the principles of this application. Obviously, the accompanying drawings in the following descriptions are merely some embodiments of this application. A person of ordinary skill in the art may further obtain other accompanying drawings according to these accompanying drawings without creative efforts. In the accompanying drawings.

DETAILED DESCRIPTION

Figure 1:
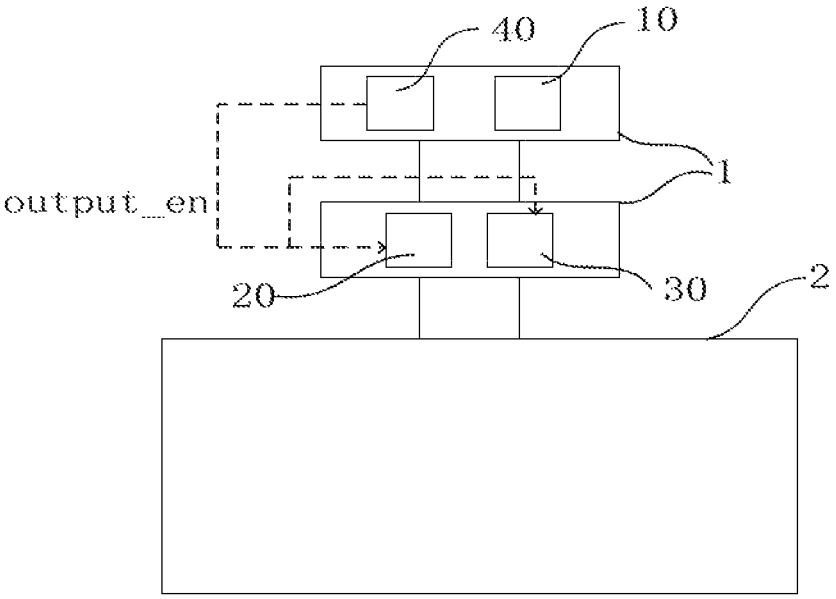
FIG. 1 is a schematic structural diagram of a testing apparatus according to an embodiment of this application.

Specific structures and functional details disclosed herein are merely representative, and are intended to describe the objectives of the exemplary embodiments of this application. However, this application may be specifically implemented in many alternative forms, and should not be construed as being limited to the embodiments set forth herein.

In the description of this application, it should be understood that orientation or position relationships indicated by the terms such as "center", "transverse", "on", "below", "left", "right", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms such as "first" and "second" are used only for the purpose of description, and should not be understood as indicating or implying the relative importance or implicitly specifying the number of the indicated technical features. Therefore, a feature defined by "first" or "second" can explicitly or implicitly include one or more of said features. In the description of this application, unless otherwise stated, "a plurality of" means two or more than two. In addition, the terms "include", "comprise" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. Persons of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "comprise" when used in this specification, specify the presence of stated features, integers, steps, operations, elements, and/or components, but do not preclude the presence or addition of one or more other features, integers, steps, operations, elements, components, and/or combinations thereof.

This application is described below with reference to the accompanying drawings and examples of embodiments.

Figure 2:
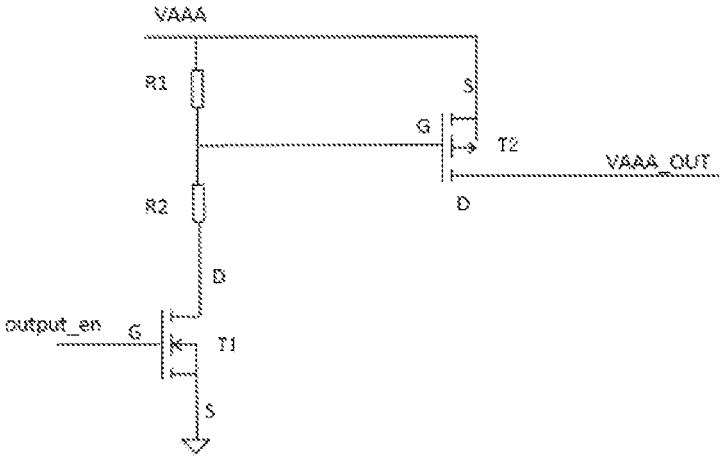
FIG. 2 is a schematic diagram of a specific circuit of a panel power-supply switch according to an embodiment of this application.
Figure 3:
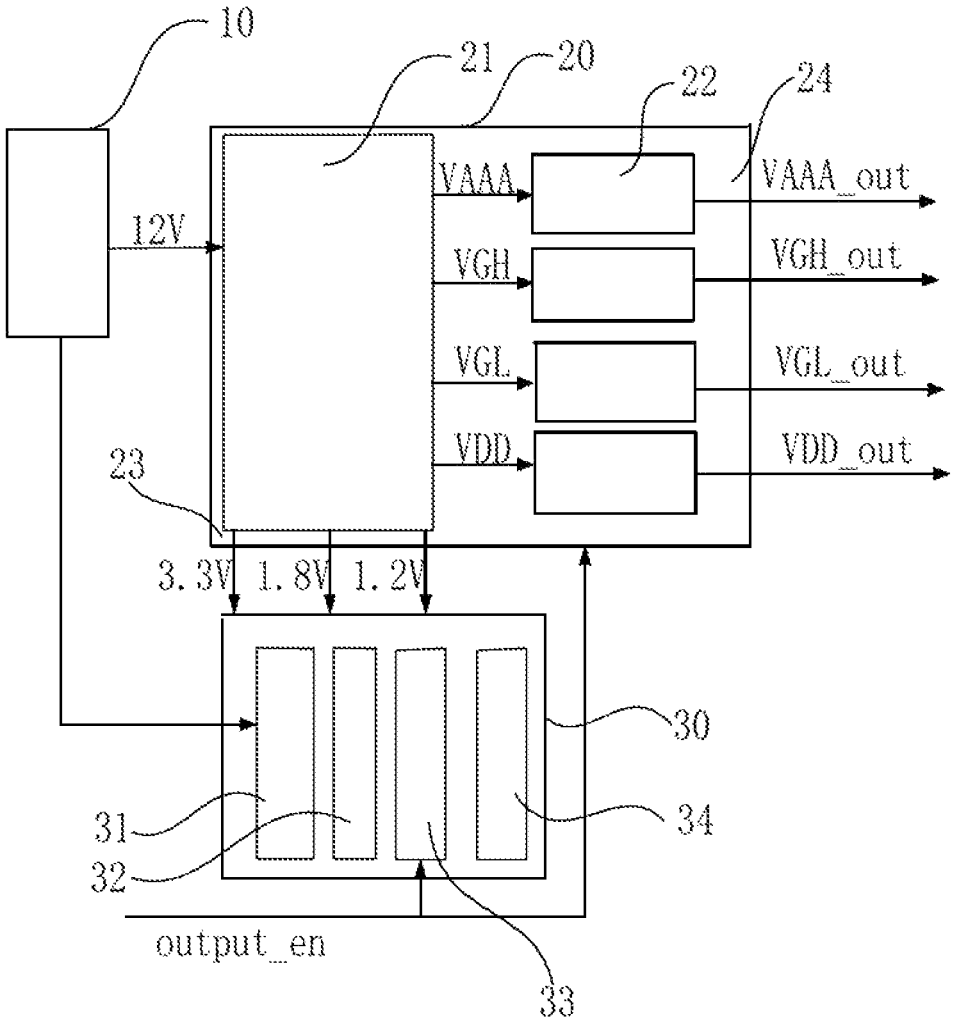
FIG. 3 is a second schematic structural diagram of a testing apparatus according to an embodiment of this application.

As shown in FIG. 1 to FIG. 3, an embodiment of this application discloses a display panel testing apparatus, including:

a testing circuit 10, configured to test a to-be-tested display panel;

a power supply circuit 20, including: a power bleeder circuit 21, configured to generate a voltage supplying power to a data control circuit 30 and a panel power-supply voltage supplying power to the display panel; a panel power-supply interface 24, configured to supply power to the to-be-tested display panel; and a panel power-supply switch 22, where the panel power-supply switch 22 is arranged between the power bleeder circuit 21 and the panel power-supply interface 24 and configured to receive the panel power-supply voltage generated by the power bleeder circuit 21; and a data control circuit 30, provided with a data interface 34 configured to control data transmission of the to-be-tested display panel.

The data control circuit 30 includes a data receiver circuit 31 and an image data processing circuit 32 connected to the data receiver circuit 31. The image data processing circuit 32 is in data connection with the to-be-tested display panel by using the data interface 34.

The data control circuit 30 further includes a high-impedance switch 33. The high-impedance switch 33 is configured to connect to and control the data interface 34.

The data receiver circuit 31 is an SOC. A preset pin of the SOC receives a signal generated by a switching signal generation circuit 40, and the high-impedance switch 33 directly calls a high-impedance component built in the SOC to control the data interface 34 that is output by the data control circuit 30 to be in a high-impedance state.

The power supply circuit 20 is provided with the panel power-supply interface 24 and a data control circuit power-supply interface 23. The panel power-supply interface 24 is configured to supply power to the to-be-tested display panel, and the data control circuit power-supply interface 23 is configured to supply power to the data control circuit 30.

The power bleeder circuit 21 is integrated in the SOC. The panel power-supply interface 24 includes four interfaces: an analog power voltage VAAA interface, a thin film transistor switch-on voltage VGH interface, a thin film transistor switch-off voltage VGL interface, and a digital power voltage VDD interface. The panel power-supply switch 22 is arranged outside the SOC. There are four panel power-supply switches 22 respectively in one-to-one control connection with the VAAA, VGH, VGL, and VDD interfaces of the SOC.

The panel power-supply switch 22 includes:

a first switch tube, a second switch tube, a first resistor, and a second resistor, where a gate of the first switch tube is configured to connect to and control an enable signal.

A drain of the first switch tube is connected, by using the first resistor and the second resistor that are connected in series, to the panel power-supply voltage generated by the power bleeder circuit 21 of the power supply circuit 20; and a source of the first switch tube is grounded.

A gate of the second switch tube is connected between the first resistor and the second resistor; a source of the second switch tube is connected to the panel power-supply voltage generated by the power bleeder circuit 21 of the power supply circuit 20; and the panel power-supply interface 24 is connected to a drain of the second switch tube.

The testing apparatus 1 further includes:

a switching signal generation circuit 40, configured to generate a first enable signal when the to-be-tested display panel needs to be replaced, and generate a second enable signal when a display panel is normally tested after the replacement.

The switching signal generation circuit 40 is configured to connect to and control the power supply circuit 20 and the data control circuit 30.

The panel power-supply switch 22 receives the signal generated by the switching signal generation circuit 40. When the power supply circuit 20 receives the first enable signal (for example, at a high level) generated by the switching signal generation circuit 40, it is considered that the to-be-tested display panel needs to be replaced, and the power supply circuit 20 controls an output of the panel power-supply interface 24 of the power supply circuit 20 to be zero V, and controls an output of the data control circuit power-supply interface 23 of the power supply circuit 20 to remain unchanged, to normally supply power to the data control circuit 30. In addition, when the high-impedance switch 33 also receives the first enable signal (for example, at a high level) generated by the switching signal generation circuit 40, the data control circuit 30 controls the data interface 34 that is output by the data control circuit 30 to be in the high-impedance state, to help replace the to-be-tested display panel without power off.

When the power supply circuit 20 receives the second enable signal (for example, at a low level) generated by the switching signal generation circuit 40, it is considered that a to-be-tested display panel is already replaced with and can be normally tested, and the power supply circuit 20 controls the output of the panel power-supply interface 24 of the power supply circuit 20 to be a normal voltage, and controls the data control circuit power-supply interface 23 of the power supply circuit 20 to output the normal voltage, to normally supply power to the data control circuit 30. In addition, when the high-impedance switch 33 also receives the second enable signal generated by the switching signal generation circuit 40, the data control circuit 30 controls the data interface 34 that is output by the data control circuit 30 to be in a normal state, to normally supply power to the to-be-tested display panel directly and test the panel.

In this solution, the testing apparatus 1 includes the switching signal generation circuit 40. When the data control circuit 30 receives the first enable signal generated by the switching signal generation circuit 40, the data control circuit 30 controls the data interface 34 that is output by the data control circuit 30 to be in the high-impedance state. In this case, an operation of replacing with a new to-be-tested display panel can be performed, and the display panel is prevented from being burned due to a short circuit. In addition, the power supply circuit 20 also receives the first enable signal generated by the switching signal generation circuit 40, the power supply circuit 20 controls the output of the panel power-supply interface 24 of the power supply circuit 20 to be zero V, and controls the output of the data control circuit power-supply interface 23 of the power supply circuit 20 to remain unchanged, to normally supply power to the data control circuit 30, so that the data control circuit 30 does not need to be opened through power off. The display panel is not burned due to a short circuit while normal replacement of the display panel is ensured, and a time of turning off a system through power off and restarting the system is eliminated, thereby improving production efficiency and decreasing production costs.

In another embodiment of this application, referring to FIG. 1 to FIG. 3, a display panel testing apparatus 1 is disclosed. The testing apparatus 1 includes:

a testing circuit 10, configured to test a to-be-tested display panel;

a power supply circuit 20; and a data control circuit 30, provided with a data interface 34 configured to control data transmission of the to-be-tested display panel, where the power supply circuit 20 is provided with a panel power-supply interface 24 and a data control circuit power-supply interface 23, the panel power-supply interface 24 is configured to supply power to the to-be-tested display panel, and the data control circuit power-supply interface 23 is configured to supply power to the data control circuit 30, where the testing apparatus 1 further includes:

a switching signal generation circuit 40, configured to generate a first enable signal when the to-be-tested display panel needs to be replaced, and generate a second enable signal when a display panel is normally tested after the replacement.

The switching signal generation circuit 40 is configured to connect to and control the power supply circuit 20 and the data control circuit 30.

When the power supply circuit 20 receives the first enable signal generated by the switching signal generation circuit 40, the power supply circuit 20 controls an output of the panel power-supply interface 24 of the power supply circuit 20 to be zero V, and controls an output of the data control circuit power-supply interface 23 of the power supply circuit 20 to remain unchanged, to normally supply power to the data control circuit 30. When the data control circuit 30 receives the first enable signal generated by the switching signal generation circuit 40, the data control circuit 30 controls the data interface 34 that is output by the data control circuit 30 to be in a high-impedance state.

When the power supply circuit 20 receives the second enable signal generated by the switching signal generation circuit 40, the power supply circuit 20 controls the output of the panel power-supply interface 24 of the power supply circuit 20 to be a normal voltage, and controls the data control circuit power-supply interface 23 of the power supply circuit 20 to output the normal voltage, to normally supply power to the data control circuit 30. When the data control circuit 30 receives the second enable signal generated by the switching signal generation circuit 40, the data control circuit 30 controls the data interface 34 that is output by the data control circuit 30 to be in a normal state.

In an embodiment, the switching signal generation circuit 40 is a physical switch arranged on the testing apparatus 1. The physical switch has simple operation and low learning costs, so that accidental touch operations are uneasy to occur, and labor costs are reduced.

In addition, the switching signal generation circuit 40 may alternatively be a virtual button arranged on display interface in a control module of the switching signal generation circuit 40. The virtual button is sensitive to touch, simple in operation, capable of making a quick response, and highly customized, and can be adaptively adjusted, modified, and so on according to requirements during actual use.

In an embodiment, the power supply circuit 20 includes:

a power bleeder circuit 21, configured to generate: a voltage supplying power to the data control circuit 30, where the voltage supplying power to the data control circuit 30 is VDD and is respectively 3.3 V, 1.8 V, and 1.2 V; and a panel power-supply voltage supplying power to the display panel, where the panel power-supply voltage is a voltage such as VGH, VGL, or VCOM.

The power supply circuit 20 further includes a panel power-supply switch 22. The panel power-supply switch 22 is arranged between the power bleeder circuit 21 and the panel power-supply interface 24 and configured to receive the panel power-supply voltage generated by the power bleeder circuit 21.

The panel power-supply switch 22 receives a signal generated by the switching signal generation circuit 40. When the power supply circuit 20 receives the first enable signal generated by the switching signal generation circuit 40, the power supply circuit controls the output of the panel power-supply interface 24 of the power supply circuit 20 to be zero V.

When the power supply circuit 20 receives the second enable signal generated by the switching signal generation circuit 40, the power supply circuit 20 controls the output of the panel power-supply interface 24 of the power supply circuit 20 to be the panel power-supply voltage.

The power bleeder circuit 21 generates voltages required by the data control circuit 30 and the display panel, to ensure normal power supply to the data control circuit 30. The panel power-supply switch 22 receives the signal generated by the switching signal generation circuit 40, so that the power supply circuit 20 controls the output of the panel power-supply interface 24 of the power supply circuit 20 to be zero V or the panel power-supply voltage. A testing system always remains in a running state, so that a time of turning off the system through power off and restarting of the system is eliminated, thereby improving production efficiency, and decreasing production costs.

In an embodiment, the panel power-supply switch 22 includes:

a first switch tube, a second switch tube, a first resistor, and a second resistor, where a gate of the first switch tube is configured to connect to and control the enable signal, a drain of the first switch tube is connected, by using the first resistor and the second resistor that are connected in series, to the panel power-supply voltage generated by the power bleeder circuit 21 of the power supply circuit 20, and a source of the first switch tube is grounded; a gate of the second switch tube is connected between the first resistor and the second resistor, a source of the second switch tube is connected to the panel power-supply voltage generated by the power bleeder circuit 21 of the power supply circuit 20, and the panel power-supply interface 24 is connected to a drain of the second switch tube.

The first switch tube is a P-type MOS transistor, and the second switch tube is an N-type MOS transistor. When the enable signal is at a high level, a voltage of the gate of the first switch tube relative to the source is greater than voltage thresholds of the source and the drain of the first switch tube, the first switch tube is conducted, and the panel power-supply voltage forms a component voltage on the first resistor and the second resistor; and a voltage of the gate of the second switch tube relative to the source is less than voltage thresholds of the source and the drain of the second switch tube, and the second switch tube is conducted. When the enable signal is at a low level, neither the first switch tube nor the second switch tube is conducted. The first switch tube is configured to connect to and control the enable signal, and on and off of the panel power-supply switch 22 can be controlled according to the enable signal, to control an output voltage of the panel power-supply interface 24.

The foregoing circuit is simple, and can be easily integrated into an SOC. In an embodiment, the power bleeder circuit 21 is integrated in the SOC, and the panel power-supply switch 22 is also integrated in the SOC.

In addition, optionally, the power bleeder circuit 21 and the panel power-supply switch 22 are both integrated in an SOC, and the power supply circuit 20 has high integrity, a small volume, and low space occupation.

In addition, optionally, the power bleeder circuit 21 may alternatively be integrated in an SOC. The panel power-supply interface 24 includes four interfaces: an analog power voltage VAAA interface, a thin film transistor switch-on voltage VGH interface, a thin film transistor switch-off voltage VGL interface, and a digital power voltage VDD interface. The panel power-supply switch 22 may alternatively be arranged outside the SOC. There are four panel power-supply switches 22 respectively in one-to-one control connection with the VAAA, VGH, VGL, and VDD interfaces of the SOC.

In addition, optionally, the panel power-supply switch 22 is arranged outside an SOC rather than inside the SOC, the panel power-supply switch 22 is independent of the SOC, and the power supply circuit 20 has a low integrity requirement and can be easily produced. The four panel power-supply switches 22 respectively control the four panel power-supply interfaces 24: the VAAA, VGH, VGL, and VDD interfaces, so that output voltages of the four panel power-supply interfaces 24 are all controlled by the enable signal.

In an embodiment, the data control circuit 30 includes:

a data receiver circuit 31 and an image data processing circuit 32 connected to the data receiver circuit 31, where the image data processing circuit 32 is in data connection with the to-be-tested display panel by using the data interface 34.

The data control circuit 30 further includes a high-impedance switch 33, where the high-impedance switch 33 is configured to connect to and control the data interface 34, and the high-impedance switch 33 receives a signal generated by the switching signal generation circuit 40. When the high-impedance switch 33 receives the first enable signal generated by the switching signal generation circuit 40, the high-impedance switch 33 controls the data interface 34 that is output by the data control circuit 30 to be in the high-impedance state.

The high-impedance switch 33 receives the first enable signal, and the high-impedance switch 33 controls the data interface 34 that is output by the data control circuit 30 to be in the high-impedance state, to replace the to-be-tested display panel.

In an embodiment, the data receiver circuit 31 is an SOC. A preset pin of the SOC receives the signal generated by the switching signal generation circuit 40, and the high-impedance switch 33 directly calls a high-impedance component built in the SOC to control the data interface 34 that is output by the data control circuit 30 to be in the high-impedance state.

The high-impedance switch 33 directly calls the high-impedance component built in the SOC to control the data interface 34 that is output by the data control circuit 30 to be in the high-impedance state, resulting in a quick processing speed.

In another embodiment of this application, referring to FIG. 1 to FIG. 3, a display panel testing method is disclosed. The method includes a step of generating a switching signal and a step of detecting the switching signal.

The step of generating a switching signal may be directly generated by controlling a physical switch or a virtual button. When a to-be-tested panel needs to be replaced, the generated switching signal is a first enable signal. After a panel is normally tested after the replacement, the generated switching signal is a second enable signal.

In the step of detecting the switching signal:

When it is detected that the switching signal is a second enable signal, a power supply circuit 20 controls an output of a panel power-supply interface 24 of the power supply circuit 20 to be a normal voltage, and controls a data control circuit power-supply interface 23 of the power supply circuit 20 to output the normal voltage, to normally supply power to a data control circuit 30; and the data control circuit controls a data interface 34 that is output by the data control circuit 30 to be in a normal state, to normally test a to-be-tested display panel.

When it is detected that the switching signal is a first enable signal, a power supply circuit 20 controls an output of a panel power-supply interface 24 of the power supply circuit 20 to be zero V, and controls an output of a data control circuit power-supply interface 23 of the power supply circuit 20 to remain unchanged, to normally supply power to a data control circuit 30; and the data control circuit 30 controls a data interface 34 that is output by the data control circuit 30 to be in a high-impedance state, to replace a to-be-tested display panel.

When the data control circuit 30 receives the first enable signal generated by a switching signal generation circuit 40, the data control circuit 30 controls the data interface 34 that is output by the data control circuit 30 to be in the high-impedance state. In this case, an operation of replacing with a new to-be-tested display panel can be performed, and the display panel is prevented from being burned due to a short circuit. In addition, the power supply circuit 20 also receives the first enable signal generated by the switching signal generation circuit 40, the power supply circuit 20 controls the output of the panel power-supply interface 24 of the power supply circuit 20 to be zero V, and controls the output of the data control circuit power-supply interface 23 of the power supply circuit 20 to remain unchanged, to normally supply power to the data control circuit 30, so that a testing system does not need to be turned off through power off. The display panel is not burned due to a short circuit while normal replacement of the display panel is ensured, and a time of turning off the system through power off and restarting the system is eliminated, thereby improving production efficiency and decreasing production costs.

The display panel of this application may be a twisted nematic (TN) panel, an in-plane switching (IPS) panel, or a multi-domain vertical alignment (VA) panel, and may certainly be any other suitable type of panel, provided that the display panel is applicable.

The foregoing contents are detailed descriptions of this application in conjunction with specific optional implementations, and it should not be considered that the specific implementation of this application is limited to these descriptions. Persons of ordinary skill in the art can further make simple deductions or replacements without departing from the concept of this application, and such deductions or replacements should all be considered as falling within the protection scope of this application.

What is claimed is:

1. A display panel testing apparatus, comprising:

a testing circuit, configured to test a to-be-tested panel;

a data control circuit, provided with a data interface configured to control data transmission of the to-be-tested panel; and a power supply circuit, wherein the power supply circuit comprises a panel power-supply interface and a data control circuit power-supply interface, the panel power-supply interface is configured to supply power to the to-be-tested panel, and the data control circuit power-supply interface is configured to supply power to the data control circuit; and the testing apparatus further comprising:

a switching signal generation circuit, configured to generate a first enable signal when the to-be-tested panel needs to be replaced, and generate a second enable signal when a panel is normally tested after the replacement, wherein the switching signal generation circuit is configured to connect to and control the power supply circuit and the data control circuit;

when the power supply circuit receives the first enable signal, the power supply circuit controls an output of the panel power-supply interface of the power supply circuit to be zero V, and controls an output of the data control circuit power-supply interface of the power supply circuit to remain unchanged, to normally supply power to the data control circuit;

when the data control circuit receives the first enable signal, the data control circuit controls the data interface that is output by the data control circuit to be in a high-impedance state;

when the power supply circuit receives the second enable signal, the power supply circuit controls the output of the panel power-supply interface of the power supply circuit to be a normal voltage, and controls the data control circuit power-supply interface of the power supply circuit to output the normal voltage, to normally supply power to the data control circuit; and when the data control circuit receives the second enable signal, the data control circuit controls the data interface that is output by the data control circuit to be in a normal state.

2. The display panel testing apparatus according to claim 1, wherein the switching signal generation circuit is a physical switch arranged on the testing apparatus.

3. The display panel testing apparatus according to claim 2, wherein the panel power-supply switch comprises:

a first switch tube, a second switch tube, a first resistor, and a second resistor, wherein a gate of the first switch tube is configured to connect to and control the enable signal;

a drain of the first switch tube is connected, by using the first resistor and the second resistor that are connected in series, to the panel power-supply voltage generated by the power bleeder circuit of the power supply circuit; and a source of the first switch tube is grounded; and a gate of the second switch tube is connected between the first resistor and the second resistor; a source of the second switch tube is connected to the panel power-supply voltage generated by the power bleeder circuit of the power supply circuit; and the panel power-supply interface is connected to a drain of the second switch tube.

4. The display panel testing apparatus according to claim 3, wherein the first switch tube is a P-type MOS transistor.

5. The display panel testing apparatus according to claim 3, wherein the second switch tube is an N-type MOS transistor.

6. The display panel testing apparatus according to claim 1, wherein the switching signal generation circuit is a virtual button arranged on a display interface in a control module of the testing apparatus.

7. The display panel testing apparatus according to claim 1, wherein the power supply circuit comprises:

a power bleeder circuit, configured to generate a voltage supplying power to the data control circuit and a panel power-supply voltage supplying power to the panel; and the power supply circuit further comprises: the panel power-supply interface, configured to supply power to the to-be-tested panel; and a panel power-supply switch, wherein the panel power-supply switch is arranged between the power bleeder circuit and the panel power-supply interface and configured to receive the panel power-supply voltage generated by the power bleeder circuit, wherein the panel power-supply switch is configured to receive a signal generated by the switching signal generation circuit; and when the power supply circuit receives the first enable signal, the power supply circuit controls the output of the panel power-supply interface of the power supply circuit to be zero V; and when the power supply circuit receives the second enable signal, the power supply circuit controls the output of the panel power-supply interface of the power supply circuit to be the panel power-supply voltage.

8. The display panel testing apparatus according to claim 7, wherein the power bleeder circuit is integrated in a system on chip (SOC).

9. The display panel testing apparatus according to claim 8, wherein the panel power-supply interface comprises four interfaces: an analog power voltage VAAA interface, a thin film transistor switch-on voltage VGH interface, a thin film transistor switch-off voltage VGL interface, and a digital power voltage VDD interface; the panel power-supply switch is arranged outside the SOC; and there are four panel power-supply switches respectively in one-to-one control connection with the VAAA, VGH, VGL, VDD interfaces of the SOC.

10. The display panel testing apparatus according to claim 9, wherein the panel power-supply switch is integrated in the SOC.

11. The display panel testing apparatus according to claim 9, wherein the panel power-supply switch is arranged outside the SOC.

12. The display panel testing apparatus according to claim 9, wherein the power bleeder circuit and the panel power-supply switch are both integrated in the SOC.

13. The display panel testing apparatus according to claim 1, wherein the data control circuit comprises:

a data receiver circuit and an image data processing circuit connected to the data receiver circuit, wherein the image data processing circuit is in data connection with the to-be-tested panel by using the data interface; and the data control circuit further comprises a high-impedance switch, wherein the high-impedance switch is configured to connect to and control the data interface, and the high-impedance switch receives a signal generated by the switching signal generation circuit; and when the high-impedance switch receives the first enable signal, the high-impedance switch controls the data interface that is output by the data control circuit to be in the high-impedance state.

14. The display panel testing apparatus according to claim 13, wherein the data receiver circuit is an SOC.

15. The display panel testing apparatus according to claim 14, wherein a preset pin of the SOC receives the signal generated by the switching signal generation circuit, and the high-impedance switch directly calls a high-impedance component built in the SOC to control the data interface that is output by the data control circuit to be in the high-impedance state.

16. A display panel testing apparatus, comprising:

a testing circuit, configured to test a to-be-tested panel;

a power supply circuit, comprising: a power bleeder circuit, configured to generate a voltage supplying power to a data control circuit and a panel power-supply voltage supplying power to the panel; a panel power-supply interface, configured to supply power to the to-be-tested panel; and a panel power-supply switch, wherein the panel power-supply switch is arranged between the power bleeder circuit and the panel power-supply interface and configured to receive the panel power-supply voltage generated by the power bleeder circuit; and a data control circuit, comprising:

a data interface, configured to control data transmission of the to-be-tested panel;

a data receiver circuit;

an image data processing circuit, connected to the data receiver circuit; and a high-impedance switch, configured to connect to and control the data interface, wherein the testing apparatus further comprises:

a switching signal generation circuit, configured to generate a first enable signal when the to-be-tested panel needs to be replaced, and generate a second enable signal when a panel is normally tested after the replacement;

the image data processing circuit is in data connection with the to-be-tested panel by using the data interface;

the data receiver circuit is a system on chip (SOC), a preset pin of the SOC receives a signal generated by the switching signal generation circuit, and the high-impedance switch directly calls a high-impedance component built in the SOC to control the data interface that is output by the data control circuit to be in a high-impedance state;

the power supply circuit is provided with the panel power-supply interface and a data control circuit power-supply interface, the panel power-supply interface is configured to supply power to the to-be-tested panel, and the data control circuit power-supply interface is configured to supply power to the data control circuit;

the power bleeder circuit is integrated in the SOC, the panel power-supply interface comprises four interfaces: an analog power voltage VAAA interface, a thin film transistor switch-on voltage VGH interface, a thin film transistor switch-off voltage VGL interface, and a digital power voltage VDD interface; the panel power-supply switch is arranged outside the SOC; and there are four panel power-supply switches respectively in one-to-one control connection with the VAAA, VGH, VGL, and VDD interfaces of the SOC; and the panel power-supply switch comprises:

a first switch tube, a second switch tube, a first resistor, and a second resistor, wherein a gate of the first switch tube is configured to connect to and control an enable signal;

a drain of the first switch tube is connected, by using the first resistor and the second resistor that are connected in series, to the panel power-supply voltage generated by the power bleeder circuit of the power supply circuit; and a source of the first switch tube is grounded; and a gate of the second switch tube is connected between the first resistor and the second resistor; a source of the second switch tube is connected to the panel power-supply voltage generated by the power bleeder circuit of the power supply circuit; and the panel power-supply interface is connected to a drain of the second switch tube, the switching signal generation circuit is configured to connect to and control the power supply circuit and the data control circuit;

the panel power-supply switch receives the signal generated by the switching signal generation circuit; and when the power supply circuit receives the first enable signal, the power supply circuit controls an output of the panel power-supply interface of the power supply circuit to be zero V, and controls an output of the data control circuit power-supply interface of the power supply circuit to remain unchanged, to normally supply power to the data control circuit;

when the high-impedance switch receives the first enable signal, the data control circuit controls the data interface that is output by the data control circuit to be in the high-impedance state;

when the power supply circuit receives the second enable signal, the power supply circuit controls the output of the panel power-supply interface of the power supply circuit to be a normal voltage, and controls the data control circuit power-supply interface of the power supply circuit to output the normal voltage, to normally supply power to the data control circuit; and when the high-impedance switch receives the second enable signal, the data control circuit controls the data interface that is output by the data control circuit to be in a normal state.

17. A display panel testing method, wherein the display panel comprises: a data control circuit, provided with a data interface configured to control data transmission of a to-be-tested panel; and a power supply circuit, wherein the power supply circuit comprises a panel power-supply interface and a data control circuit power-supply interface, the panel power-supply interface is configured to supply power to the to-be-tested panel, and the data control circuit power-supply interface is configured to supply power to the data control circuit; and the testing method comprises:

a step of generating a switching signal; and a step of detecting the switching signal, wherein when it is detected that the switching signal is a second enable signal, controlling, by the power supply circuit, an output of a panel power-supply interface of the power supply circuit to be a normal voltage, and controlling a data control circuit power-supply interface of the power supply circuit to output the normal voltage, to normally supply power to the data control circuit; and controlling, by the data control circuit, a data interface that is output by the data control circuit to be in a normal state, to normally test a to-be-tested panel; or when it is detected that the switching signal is a first enable signal, controlling, by the power supply circuit, an output of a panel power-supply interface of the power supply circuit to be zero V, and controlling an output of a data control circuit power-supply interface of the power supply circuit to remain unchanged, to normally supply power to the data control circuit; and controlling, by the data control circuit, a data interface that is output by the data control circuit to be in a high-impedance state, to replace a to-be-tested panel.

* * * * *